US011777205B2

(12) United States Patent
Cheng et al.

(10) Patent No.: US 11,777,205 B2
(45) Date of Patent: Oct. 3, 2023

(54) PERIODIC METAL ARRAY STRUCTURE

(71) Applicant: Alpha Networks Inc., Hsinchu (TW)

(72) Inventors: Chih Jen Cheng, Hsinchu (TW); Guan-Ting Chen, Hsinchu (TW); Shu Min Fang, Hsinchu (TW)

(73) Assignee: Alpha Networks Inc., Hsinchu (TW)

( * ) Notice: Subject to any disclaimer, the term of this patent is extended or adjusted under 35 U.S.C. 154(b) by 21 days.

(21) Appl. No.: 17/694,666

(22) Filed: Mar. 15, 2022

(65) Prior Publication Data

US 2023/0140166 A1 May 4, 2023

(30) Foreign Application Priority Data

Oct. 29, 2021 (TW) ..... 110140473

(51) Int. Cl.
*H01Q 1/52* (2006.01)
*H01Q 21/06* (2006.01)
*H01Q 21/00* (2006.01)

(52) U.S. Cl.
CPC ..... *H01Q 1/523* (2013.01); *H01Q 21/0025* (2013.01); *H01Q 21/065* (2013.01)

(58) Field of Classification Search
CPC .... H01Q 1/523; H01Q 21/0025; H01Q 21/06; H01Q 21/061; H01Q 21/08
See application file for complete search history.

(56) References Cited

U.S. PATENT DOCUMENTS 5,926,137 A * 7/1999 Nealy ..... H01Q 21/245 343/873
6,825,816 B2 * 11/2004 Aikawa ..... H01Q 13/10 343/770
7,268,736 B1 * 9/2007 Tikhov ..... H01Q 1/2208 343/770
8,259,032 B1 * 9/2012 Buckley ..... H01Q 1/40 343/873
8,816,936 B2 * 8/2014 Toyao ..... H01Q 15/006 343/909

(Continued)

FOREIGN PATENT DOCUMENTS

CN 102683869 A 9/2012
CN 106848583 A 6/2017

(Continued)

*Primary Examiner* — Jason Crawford
(74) *Attorney, Agent, or Firm* — CIPO IP Group

(57) ABSTRACT

A periodic metal array structure can be disposed between two antenna modules and include rows of metal unit assemblies that each includes metal units connected to each other in a longitudinal direction. Each metal unit has a first longitudinal strip, two first transverse strips, two second transverse strips, and two second longitudinal strips having shorter longitudinal lengths than that of the first longitudinal strip, and being respectively disposed on the left and right sides of the first longitudinal strip and respectively spaced apart therefrom by intervals at which the second transverse strips are located. The top and bottom ends of the first longitudinal strip are respectively connected with the first transverse strips. At least one first transverse strip can be connected to a first transverse strip of an adjacent metal unit. Each second transverse strip can be connected to the first longitudinal strip and a corresponding second longitudinal strip.

12 Claims, 4 Drawing Sheets

(56) References Cited

U.S. PATENT DOCUMENTS

| | | | | |
|---|---|---|---|---|
| 10,411,505 | B2 * | 9/2019 | Shao | H02J 50/402 |
| 10,886,622 | B1 | 1/2021 | Patel | |
| 11,217,902 | B2 * | 1/2022 | Pelletti | G01S 13/04 |
| 2012/0038534 | A1 * | 2/2012 | Su | H01Q 7/00 343/835 |
| 2014/0043189 | A1 * | 2/2014 | Lee | H01Q 9/0485 342/368 |
| 2018/0269585 | A1 * | 9/2018 | Kim, II | H01Q 21/0006 |
| 2020/0028275 | A1 * | 1/2020 | Ahmadloo | H01Q 1/3233 |
| 2020/0161754 | A1 * | 5/2020 | Cho | H01L 23/66 |
| 2022/0209411 | A1 * | 6/2022 | Che | H01Q 1/523 |
| 2022/0294107 | A1 * | 9/2022 | Koul | H04B 7/0469 |

FOREIGN PATENT DOCUMENTS

| | | | |
|---|---|---|---|
| CN | 107785661 | A | 3/2018 |
| CN | 108682931 | A | 10/2018 |
| CN | 110611153 | A | 12/2019 |
| CN | 212676475 | U | 3/2021 |
| TW | 201320467 | A | 5/2013 |
| TW | I93249 | B | 7/2017 |
| TW | I631770 | B | 8/2018 |
| TW | I688156 | B | 3/2020 |
| TW | I718599 | B | 2/2021 |

* cited by examiner

PERIODIC METAL ARRAY STRUCTURE

CROSS-REFERENCE TO RELATED PATENT APPLICATION

This non-provisional application claims priority to and the benefit of, under 35 U.S.C. § 119(a), Taiwan Patent Application No. 110140473, filed Oct. 29, 2021 in Taiwan. The entire content of the above identified application is incorporated herein by reference.

FIELD

The present disclosure relates to a periodic metal array structure, and more particularly to a periodic metal array structure located between two antenna modules to form a planar antenna array system and including a plurality of rows of metal unit assemblies each including a plurality of metal units.

BACKGROUND

With the rapid advancement of the wireless communication industry, wireless communication devices have been improved and upgraded continually. In the meantime, market requirements for such devices have evolved beyond a thin and compact design to also include communication quality, such as the stability of signal transmission. "Antennas" are a key element of wireless communication devices and are indispensable to the reception and transmission of wireless signals and to data transfer. The development of antenna-related technologies has been a focus of attention in the related technical fields as the wireless communication industry continues to flourish.

As a result of the design trend of wireless communication equipment toward miniaturization, the volume of the antennas adopted therein needs to be reduced accordingly. The current small antennas are mostly chip antennas and planar antennas. Among them, planar antennas are mostly microstrip antennas and printed antennas. However, due to the light and thin design of wireless communication equipment, the circuit boards therein are also relatively short and small. If a manufacture needs to preserve an area on a circuit board for antenna installation, not only would the installation areas of other electronic components be reduced, which increases the circuit board design difficulty for a manufacturer, but also will the antenna and other electronic components be very close to each other. Particularly, when there are multiple antennas on a circuit board, the isolation of the antennas can easily deteriorate due to mutual coupling, resulting in a decrease in radiation quality, and serious affection on the signal quality of the antennas.

In order to solve the aforementioned issues, many manufacturers have developed a variety of isolation methods for multiple antennas. For example, increasing the distance between the antennas, or adding decoupling mechanism between the antennas in the hope of reducing the amount of coupling between the antennas. Nevertheless, as antenna configurations and operating frequencies differ, corresponding adjustments must be made respectively to the various isolation methods, with no simple generalization available. In other words, antenna isolation remains to be a major difficulty in antenna design. Therefore, one of the important issues addressed in the present disclosure is to improve antenna isolation in a limited area for antenna arrays.

SUMMARY

Where the antennas of wireless communication equipment are applied in various frequency bands, the shape of antenna radiation fields and antenna system performance are decided by factors including the relative strengths of the feed signals of antenna modules, input impedance difference, demand for high gain characteristics, etc. Therefore, the strength and isolation of antenna signals are extremely important for an antenna system. Therefore, in order to stand out in a highly competitive market, based on years of in-depth practical experience in the design, processing and manufacturing of various antenna systems, the excellence-striving research spirit, and longtime research and experimentation, the present disclosure presents a periodic metal array structure whose advent is expected to provide users with better use experience.

Certain aspects of the present disclosure are directed to a periodic metal array structure located between two antenna modules to form a planar antenna array system and including a plurality of rows of metal unit assemblies arranged in a transverse direction. Each adjacent two metal unit assemblies are spaced apart from each other by a first interval. Each metal unit assembly includes a plurality of metal units connected to each other in a longitudinal direction. Each of the metal units has a first longitudinal strip extending in the longitudinal direction, two first transverse strips extending in the transverse direction and respectively connected with the top and bottom ends of the first longitudinal strip, two second longitudinal strips extending in the longitudinal direction and respectively disposed on left and right sides of the first longitudinal strip, and two second transverse strips extending in the transverse direction and disposed on the left and right sides of the first longitudinal strip respectively. At least one of the first transverse strips can be connected with a first transverse strip of another one of the metal units. Each second longitudinal strip has a shorter longitudinal length than a longitudinal length of the first longitudinal strip, and is spaced apart from the first longitudinal strip by a second interval. Each of the second transverse strips has one end connected to the first longitudinal strip and the other end connected to a corresponding one of the second longitudinal strips.

In certain embodiments, a working frequency of the planar antenna array system is 28 GHz.

In certain embodiments, the first interval is 0.3 mm.

In certain embodiments, at least one of the metal unit assemblies includes three metal units, and a total longitudinal length of the metal unit assembly is 4.98 mm.

In certain embodiments, the periodic metal array structure includes three rows of metal unit assemblies.

In certain embodiments, the two second longitudinal strips do not extend beyond two ends of each of the first transverse strips in the transverse direction.

In certain embodiments, each of the first transverse strips has a transverse length of 0.5 mm.

In certain embodiments, the first transverse strip has a longitudinal length of 0.08 mm.

In certain embodiments, each of the second longitudinal strip has a longitudinal length of 1 mm and a transverse length of 0.08 mm.

In certain embodiments, the other end of the second transverse strip is connected to a central region of the corresponding second longitudinal strip.

In certain embodiments, the second transverse strip has a transverse length of 0.11 mm.

In certain embodiments, the second transverse strip has a longitudinal length of 0.08 mm.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION

Figure 1:
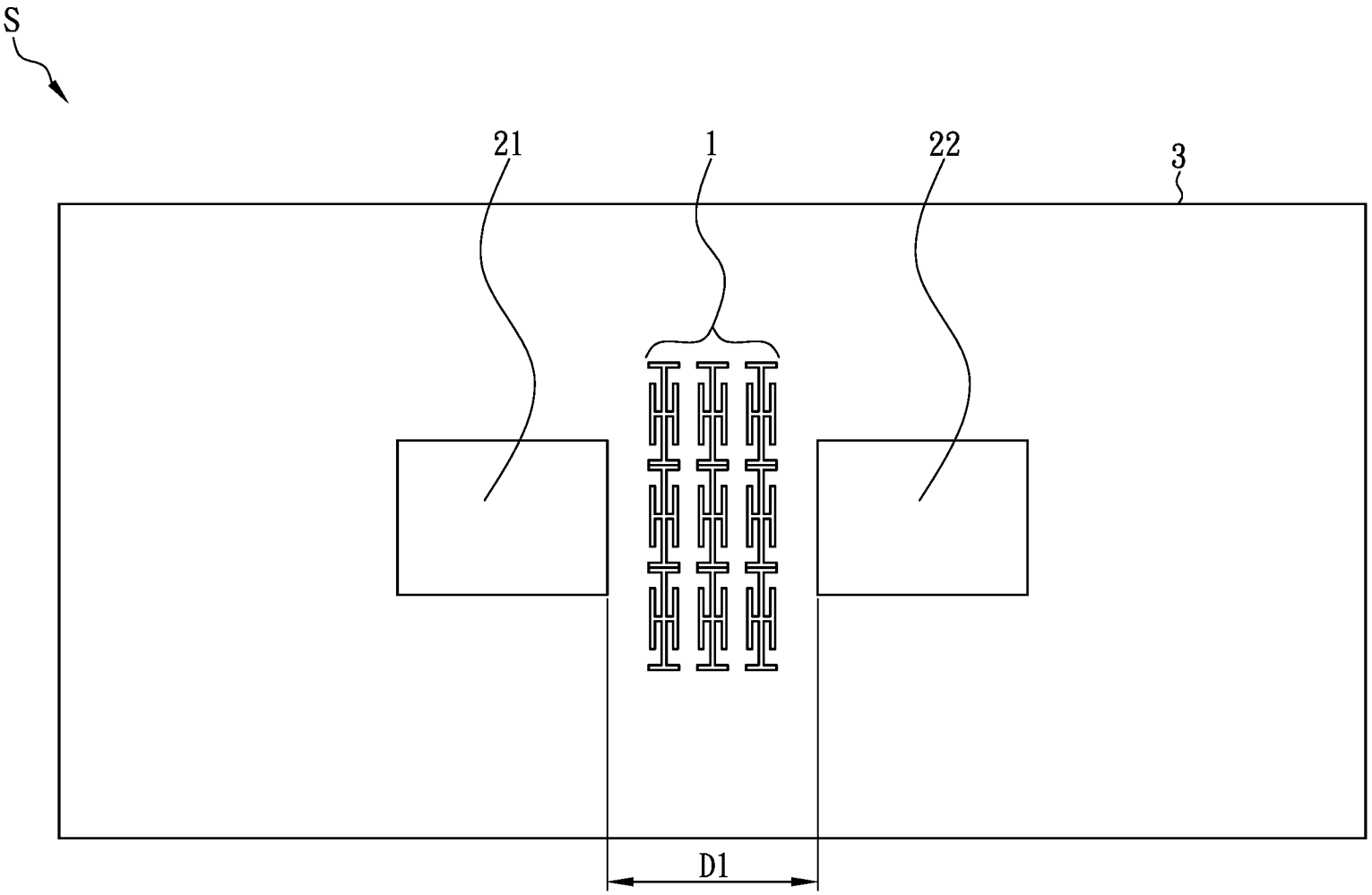
FIG. 1 is a schematic diagram of a planar antenna array system according to certain embodiments in the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The accompanying drawings are schematic and may not have been drawn to scale. The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, materials, objects, or the like, which are for distinguishing one component/material/object from another one only, and are not intended to, nor should be construed to impose any substantive limitations on the components, materials, objects, or the like. Directional terms (e.g., "front", "rear", "left", "right", "upper/top" and/or "lower/bottom") are explanatory only and are not intended to be restrictive of the scope of the present disclosure. As used herein, a numeral value referred in the present disclosure can include a value, or an average of values, in an acceptable deviation range of a particular value recognized or decided by a person of ordinary skill in the art, taking into account any specific quantity of errors related to the measurement of the value that may resulted from limitations of a measurement system or device. For example, a particular numeral value referred in the embodiments of the present disclosure can include ±5%, ±3%, ±1%, ±0.5% or ±0.1%, or one or more standard deviations, of the particular numeral value.

Referring to FIG. 1, a periodic metal array structure 1 can be located between two antenna modules 21, 22 to form a planar antenna array system S. In certain embodiments, the working frequency of the planar antenna array system S is 28 GHz, and the two antenna modules 21, 22 can be planar antennas. In certain embodiments, each of the two antenna modules 21, 22 has a rectangular shape with a length, from the left, side to the right side, of 3.2 mm, a width, from the top side to the bottom side, of 2.4 mm. The two antenna modules 21, 22 can be spaced apart by a distance D1, and be disposed on a circuit board 3. In certain embodiments, the distance D1 can be 3.2 mm. However, the present disclosure is not limited thereto. In certain embodiments, a manufacturer can adjust the working frequency of the planar antenna array system S or adjust the distance D1 of the antenna modules 21, 22 according to product requirements. The planar antenna-circuit board electrical connection relationship and feed point therebetween are omitted herein for the brevity of description.

Figure 2:
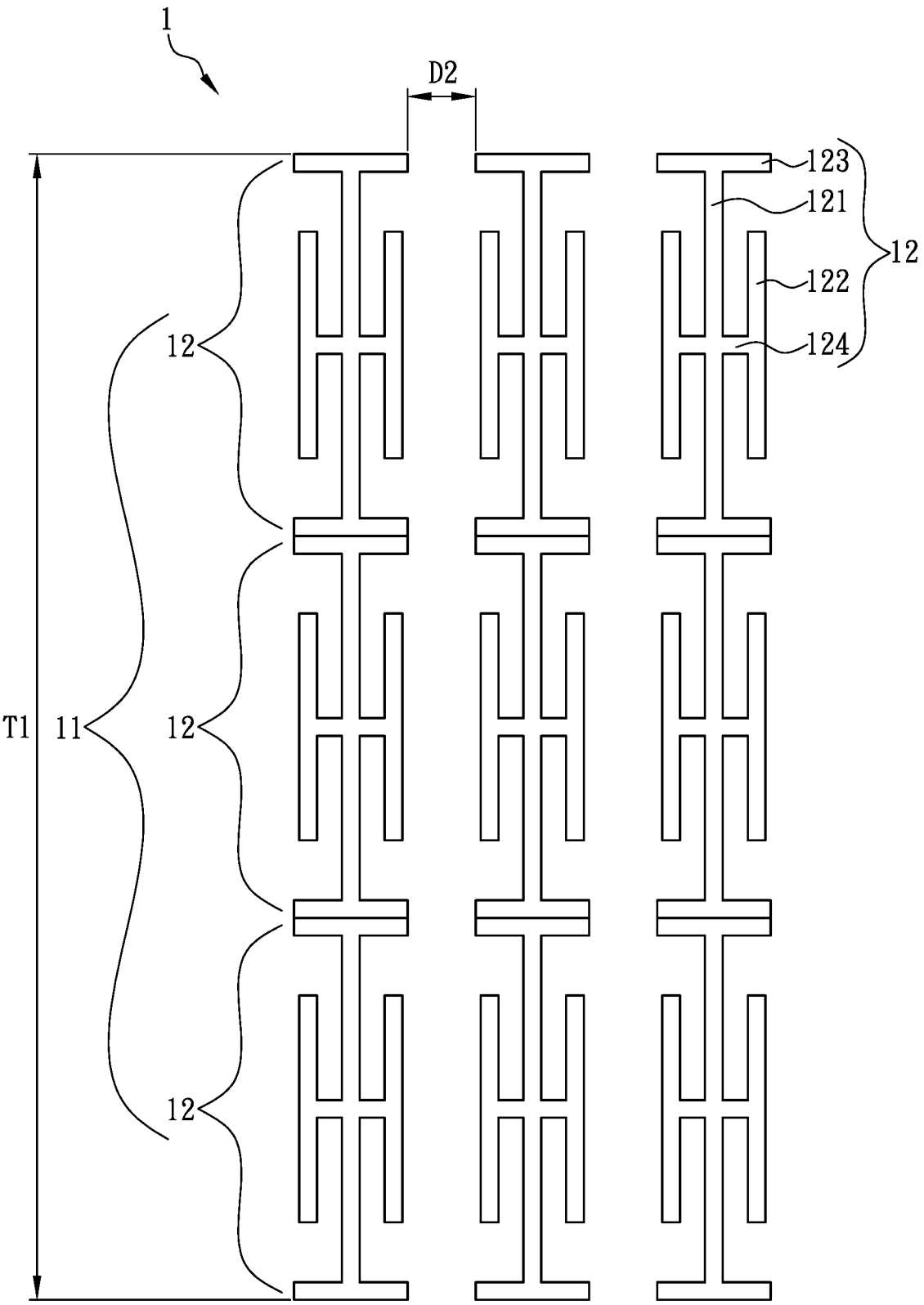
FIG. 2 is a schematic diagram of a periodic metal array structure according to certain embodiments in the present disclosure.

Referring to FIG. 1 and FIG. 2, the periodic metal array structure 1 includes a plurality of metal unit assemblies 11 arranged in rows. In certain embodiments, the periodic metal array structure 1 includes three rows of metal unit assemblies 11 sequentially arranged from left to right in a transverse direction (with reference to the directions shown in FIG. 1), and each adjacent two metal unit assemblies 11 are spaced apart from each other by an interval D2. In certain embodiments, the interval D2 can be 0.3 mm. Neither of the two outer metal unit assemblies 11 is in contact with the adjacent antenna module 21 or 22. Each metal unit assembly 11 includes a plurality of metal units 12 that are sequentially connected to each other in a longitudinal direction. In certain embodiments, each metal unit assembly 11 includes three metal units 12 and has a total longitudinal length T1 of 4.98 mm. However, the present disclosure is not limited thereto, and in certain embodiments, the number of the metal units 12 in each metal unit assembly 11 may be adjusted according to practical needs.

Figure 3:
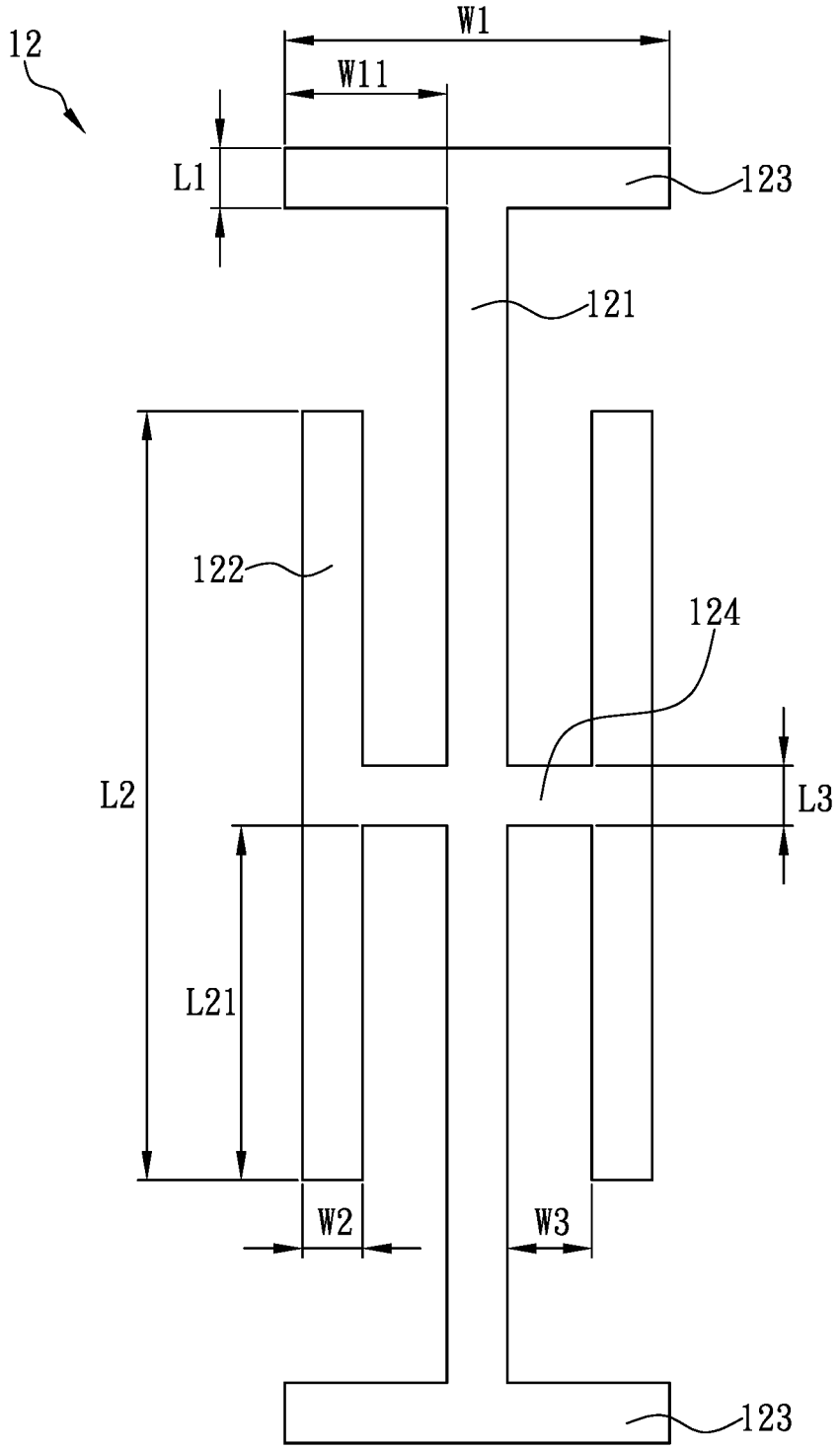
FIG. 3 is a schematic diagram of a metal unit according to certain embodiments in the present disclosure.

Referring to FIG. 3 in conjunction with FIG. 2, a metal unit 12 has a first longitudinal strip 121, two second longitudinal strips 122, two first transverse strips 123, and two second transverse strips 124. The first longitudinal strip 121 extends in the longitudinal direction (i.e., the direction extending through the top and bottom edges of FIG. 2). The top and bottom ends of the first longitudinal strip 121 are respectively connected with the first transverse strips 123. Each of the first transverse strips 123 extends in the transverse direction (i.e., the direction extending through the left and right edges of FIG. 2). In certain embodiments, each first transverse strip 123 has a transverse length W1 of 0.5 mm and a longitudinal length L1 of 0.08 mm, and each of the two ends of the first longitudinal strip 121 is connected to a central region of a corresponding first transverse strip 123 such that, as shown in FIG. 3, each first transverse strip 123 has a left section and a right section that do not correspond to the first longitudinal strip 121. Each of the left and right sections can have a transverse length W11 of 0.21 mm. However, the present disclosure is not limited thereto. Each two adjacent metal units 12 in the same row can be connected through corresponding first transverse strips 123. For example, as shown in FIG. 2, the middle metal unit 12 in each row has its two first transverse strips 123 respectively connected to the corresponding first transverse strips 123 of the adjacent metal units 12. In other words, in FIG. 2, each metal unit 12 has at least one first transverse strip 123 connected to a corresponding first transverse strip 123 of another metal unit 12.

Referring again to FIG. 3 in conjunction with FIG. 2, the two second longitudinal strips 122 extend in the longitudinal direction, have shorter longitudinal lengths than the longitudinal length of the first longitudinal strip 121, and are respectively disposed on the left and right sides of the first longitudinal strip 121 in such a way that the two second longitudinal strips 122 lie between the two first transverse strips 123. In certain embodiments, the two second longitudinal strips 122 do not extend beyond the two ends of each first transverse strip 123 in the transverse direction. In certain embodiments, the outer peripheral of at least one of the two second longitudinal strips 122 may extend beyond the corresponding outer end edges of the first transverse strips 123 in the transverse direction, either in response to product requirements or as allowed within manufacturing tolerances. In certain embodiments, each second longitudinal strip 122 has a longitudinal length L2 of 1 mm and a transverse length W2 of 0.08 mm and is spaced apart from the first longitudinal strip 121 by an interval. In certain embodiments, the interval may be 0.11 mm.

With continued reference to FIG. 3 in conjunction with FIG. 2, the two second transverse strips 124 extend in the transverse direction, are disposed on the left and right sides of the first longitudinal strip 121 respectively, and are located respectively within the two intervals between the first longitudinal strip 121 and the second longitudinal strips 122. Each second transverse strip 124 has one end connected to the first longitudinal strip 121 and the other end connected to a corresponding second longitudinal strip 122 such that the two second longitudinal strips 122 and the two second transverse strips 124 roughly form an H shape. In certain embodiments, each second transverse strip 124 has a longitudinal length L3 of 0.08 mm and a transverse length W3 of 0.11 mm (which is equivalent to the interval between the first longitudinal strip 121 and a second longitudinal strips 122 being 0.11 mm), and the other end of each second transverse strip 124 is connected to a central region of a corresponding second longitudinal strip 122 such that, as viewed in FIG. 3, each second longitudinal strip 122 has an upper section and a lower section that do not correspond to the second transverse strip 124 and each of which has a longitudinal length L21 of 0.46 mm.

Figure 4:
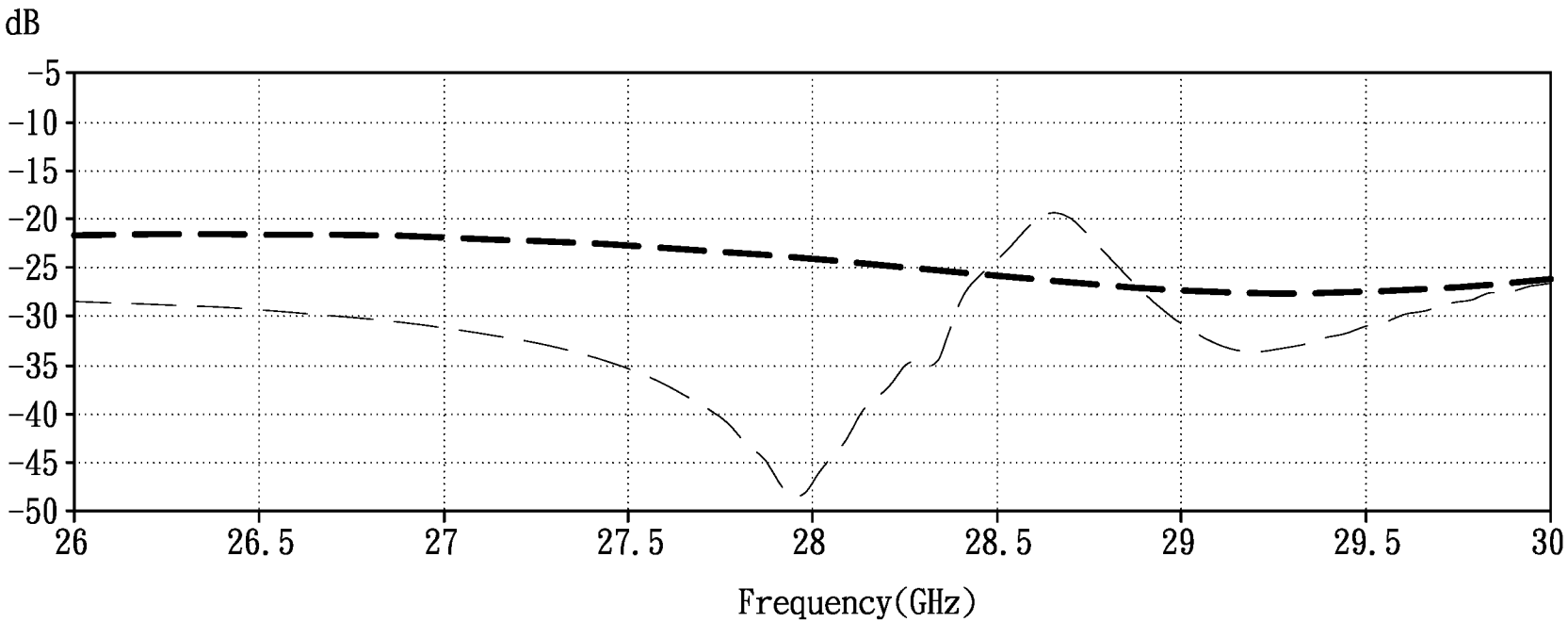
FIG. 4 is a schematic diagram showing the results of isolation characteristics of the planar antenna array system having and not having the periodic metal array structure according to certain embodiments in the present disclosure.

According to the simulation test results shown in FIG. 4, the isolation between the antenna modules 21 and 22 at an working frequency of 28 GHz is −24.156 dB when the planar antenna array system S is not provided with the periodic metal array structure 1 (see the thick dashed line in FIG. 4), and the isolation between the antenna modules 21 and 22 at the same working frequency of 28 GHz becomes −47.081 dB when the planar antenna array system S is provided with the periodic metal array structure 1 (see the thin dashed line in FIG. 4). It can be inferred from the above that by the periodic metal array structure 1, better isolation can be provided by disturbing the surface current of the antenna modules 21 and 22 and reducing the field quantities of back radiation. Therefore, the radiation intensity of main-beam signals of antenna arrays is enhanced while the intensity of side-lobe signals is suppressed. Moreover, the periodic metal array structure 1 and the antenna modules 21 and 22 can be designed on the same plane to maintain the integrity of the grounding surfaces of the antenna modules 21 and 22.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A periodic metal array structure located between two antenna modules to form a planar antenna array system and comprising a plurality of rows of metal unit assemblies arranged in a transverse direction, wherein each adjacent two metal unit assemblies are spaced apart from each other by a first interval, each of the metal unit assemblies comprises a plurality of metal units connected to each other in a longitudinal direction, and each of the metal units has:

a first longitudinal strip extending in the longitudinal direction;

two first transverse strips extending in the transverse direction and respectively connected with top and bottom ends of the first longitudinal strip, wherein at least one of the first transverse strips is configured to be connected with a first transverse strip of another one of the metal units;

two second longitudinal strips extending in the longitudinal direction and respectively disposed on left and right sides of the first longitudinal strip, each having a longitudinal length shorter than a longitudinal length of the first longitudinal strip, and being spaced apart from the first longitudinal strip by a second interval; and two second transverse strips extending in the transverse direction and disposed on the left and right sides of the first longitudinal strip respectively, each of the second transverse strips having one end connected to the first longitudinal strip and the other end connected to a corresponding one of the second longitudinal strips.

2. The periodic metal array structure according to claim 1, wherein a working frequency of the planar antenna array system is 28 GHz.

3. The periodic metal array structure according to claim 1, wherein the first interval is 0.3 mm.

4. The periodic metal array structure according to claim 1, wherein at least one of the metal unit assemblies comprises three metal units, and a total longitudinal length of the metal unit assembly is 4.98 mm.

5. The periodic metal array structure according to claim 1, comprising three rows of metal unit assemblies.

6. The periodic metal array structure according to claim 1, wherein the two second longitudinal strips do not extend beyond two ends of each of the first transverse strips in the transverse direction.

7. The periodic metal array structure according to claim 6, wherein each of the first transverse strips has a transverse length of 0.5 mm.

8. The periodic metal array structure according to claim 7, wherein the first transverse strip has a longitudinal length of 0.08 mm.

9. The periodic metal array structure according to claim 1, wherein each of the second longitudinal strips has a longitudinal length of 1 mm and a transverse length of 0.08 mm.

10. The periodic metal array structure according to claim 9, wherein the other end of the second transverse strip is connected to a central region of the corresponding second longitudinal strip.

11. The periodic metal array structure according to claim 1, wherein the second transverse strip has a transverse length of 0.11 mm.

12. The periodic metal array structure according to claim 1, wherein the second transverse strip has a longitudinal length of 0.08 mm.

* * * * *